United States Patent [19]

Lou et al.

[11] Patent Number: 4,582,750

[45] Date of Patent: Apr. 15, 1986

[54] PROCESS FOR MAKING A NONWOVEN FABRIC OF NEEDLING, HEATING, BURNISHING AND COOLING

[75] Inventors: Gene W. Lou, Hendersonville; Leon H. Zimmerman, Jr., Nashville, both of Tenn.

[73] Assignee: E. I. Du Pont de Nemours and Company, Wilmington, Del.

[21] Appl. No.: 723,687

[22] Filed: Apr. 16, 1985

[51] Int. Cl.[4] ..... D04H 1/04

[52] U.S. Cl. ..... 428/288; 156/148; 156/181; 156/296; 264/25; 428/296; 428/300; 428/409

[58] Field of Search ..... 428/288, 409, 296, 300; 156/148, 181, 296; 264/25

[56] References Cited

U.S. PATENT DOCUMENTS

| | | | |
|---|---|---|---|
| 4,042,655 | 8/1977 | Platt et al. | 264/25 |
| 4,342,813 | 8/1982 | Erikson | 428/296 |
| 4,363,682 | 12/1982 | Thiebault | 156/181 |

*Primary Examiner*—Marion C. McCamish

[57] ABSTRACT

A process is provided for making strong, permeable nonwoven fabrics having an abrasion-resistant burnished surface. The process involves providing a lightly consolidated or weakly bonded web of thermoplastic synthetic organic fibers, needle punching the web, heating a surface of the needled web, and burnishing the heated surface with a rotating, smooth-surfaced metal roll, which preferably simultaneously cools the web surface.

7 Claims, 1 Drawing Figure

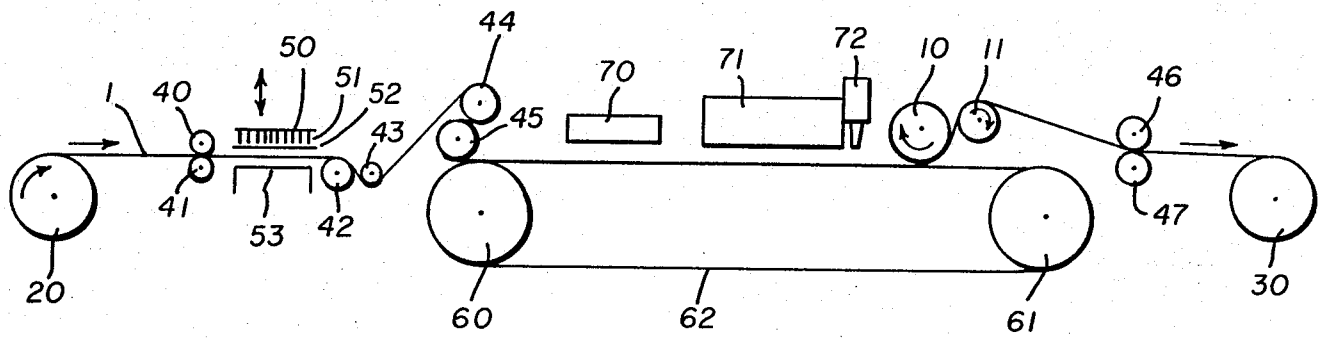
30
46
47
61
11
10
72
71
62
70
44
45
60
52
43
51
42
50
53
40
41
1
20

PROCESS FOR MAKING A NONWOVEN FABRIC OF NEEDLING, HEATING, BURNISHING AND COOLING

BACKGROUND OF THE INVENTION

1. Field of the Invention

This invention relates to a process for preparing a nonwoven fabric of thermoplastic, synthetic organic fibers. More particularly, the invention concerns such a process and a novel product produced thereby. The process involves the steps of needling, heating, burnishing and cooling.

2. Description of the Prior Art

Processes are known for making strong, permeable nonwoven fabrics having at least one abrasion-resistant surface. For example, Platt et al., U.S. Pat. No. 4,042,655 and Erikson, U.S. Pat. No. 4,342,813 disclose processes wherein batts of polypropylene fibers are subjected in sequence to needling, infra-red heating, calendering, cooling and winding up. Such fabrics have been suggested for use in lamination, furniture tickings, mattress-spring pocketting and the like. In several of these end uses, the nonwoven fabric requires special characteristics, in addition to the usually desired high strength and tear properties. For example, to function well as a mattress-spring pocketting, the nonwoven fabric should have at least one highly abrasion-resistant surface and sufficient permeability to permit the quiet passage of air in and out of the pocketting during repeated in-use compressions and expansions of the mattress springs. As another example, to function well in certain lamination uses (e.g., wallpaper), the nonwoven fabric should have one abrasion-resistant surface and an opposite surface that accepts adhesives well.

Although not concerned with the above-described types of products or processes, Thiebault. U.S. Pat. No. 4,363,682 discloses a method for making an electric filter face mask in which a fluffy surface layer of a nonwoven, highly aerated mass of polypropylene fibers is smoothed by being heated under low pressure and light friction by a metal mass having a temperature between 115° to 150° C. to form a skin or porous glaze on the surface.

Each of the above-described processes provides a nonwoven fabric which has at least one relatively abrasion-resistant surface whose characteristics differ considerably from those of the mass of fibers beneath the surface. However, the utility of these products could be enhanced significantly by improvements in the uniformity of the surface and/or the strength of the fabric. A purpose of this invention is to provide a process for making such improved fabrics.

SUMMARY OF THE INVENTION

The present invention provides a process for preparing a strong, permeable nonwoven fabric having an abrasion-resistant surface. The process comprises (a) providing a lightly consolidated web of thermoplastic, synthetic organic fibers, the web having a unit weight in the range of 75 to 150 grams/square meter, the fibers having a dtex in the range of 1.5 to 15 and at least a minor portion of the fibers having melting temperatures in the range of 160° to 190° C. (b) needle-punching the web to form 30 to 150 penetrations/square centimeter, (c) heating at least one surface of the needled web to a temperature of at least 140° C. (d) burnishing the heated surface of the web with a rotating, smooth-surfaced metal roll and (e) cooling the burnished web. Preferably, the roll rotates with a peripheral velocity of at least 25 meters/minute relative to the web, is maintained in intimate frictional contact with the web for at least one second and simultaneously burnishes and cools the heated needled web. In one preferred embodiment of the process, the lightly consolidated web comprises substantially continuous filaments of isotactic polypropylene, the surface of the needled web is heated to a temperature in the range of 145° to 156° C. and the roll surface is maintained at a temperature of lower than 60° C. In another embodiment, the lightly consolidated web comprises a major portion of substantially continuous filaments of poly(ethylene terephthalate) homopolymer and a minor portion of substantially continuous filaments of poly(ethylene terephthalate/isophthalate) copolymer, the needled web is heated to a temperature in the range of 195° to 210° C. and the roll surface is maintained at a temperature of lower than 90° C.

The present invention also provides a novel strong, permeable nonwoven fabric having an abrasion-resistant, burnished surface.

BRIEF DESCRIPTION OF THE DRAWING

The invention will be more fully understood by reference to the attached drawing which is a schematic diagram of equipment suitable for carrying out the process of the invention. Operation of the equipment is described in detail in the Examples of the invention included hereinafter.

DETAILED DESCRIPTION OF PREFERRED EMBODIMENTS

As noted above, the process of the present invention includes (a) providing a starting web of thermoplastic synthetic organic fibers, (b) needle-punching the web, (c) heating a surface of the needled web, (d) burnishing the heated surface of the web with rotating roll and (e) cooling the burnished web.

The starting web for the process of the present invention is prepared from thermoplastic synthetic organic fibers by known techniques. The web may comprise fibers which are substantially continuous filaments or which are staple fibers. If staple fibers are employed, fiber lengths of at least 2 cm are generally desired in order to permit the subsequent needling step to impart adequate strength to the web. Such staple-fiber webs can be prepared by conventional carding and cross-lapping techniques. However, for higher strength products continuous filament webs are usually preferred. Such continuous filament webs can be prepared by known techniques, such as those employed to manufacture spunbonded products of the types disclosed, for example in Henderson, U.S. Pat. No. 3,821,062 or Estes et al., U.S. Pat. No. 3,989,788, the entire disclosures of which are hereby incorporated by reference. According to these patents, continuous filaments of organic polymer are melt spun, collected as a web on a moving receiver and then heated to bond the filaments together and form a strong nonwoven fabric. However, for use in the present invention mild bonding conditions or light consolidations are employed in order to avoid the fiber breakage that would otherwise occur in the subsequent needling step.

In practice of the present invention, a fairly wide range of starting webs can be used. It is necessary only that the webs have sufficient strength to permit satisfactory handling in subsequent processing steps and that the fibers of the web not be so strongly bonded that they break and weaken the web when the web is needled.

Generally the starting webs weigh between 75 and 150 g/m$^2$. For reasons of economy, preferred webs weigh 85 to 115 g/m$^2$. The dtex of the fibers is generally in the range of 1.5 to 15. However, for the same weight of web, fibers of lower dtex usually provide the final product with a more uniform appearance. Accordingly, fibers of 3 to 7 dtex are preferred.

In addition to the above-described features, the starting webs for use in the process of the present invention include at least a minor portion of its fibers which have melting temperatures in the range of 160° to 190° C. Preferred fibers meeting this melting range criterion include fibers of isotactic polypropylene and fibers made from a copolymer of poly(ethylene terephthalate/isophthalate). When the copolymer fibers are use, it is preferred to include them in a web which contains primarily poly(ethylene terephthalate) homopolymer fibers, as illustrated hereinafter in Examples 7-11. The preferred starting web is of continuous filaments of isotactic polypropylene, as illustrated in Examples 1-5.

In the needling step of the process of the invention, conventional needle looms equipped with barbed needles are suitable for treating the lightly bonded or lightly consolidated starting webs. Generally, penetration rates of 500 to 1200 strokes per minute are used to provide between 30 and 150 penetrations/cm$^2$. The needling treatment rearranges the fibers in the web. Fibers from one surface of the web are caused to extend through thickness of the web and entangle with fibers on the opposite surface of the web. The needling significantly increases the strength of the usually rather weak, starting web.

Immediately after the needling step and prior to the burnishing step, the web is placed under tension, preferably in both the longitudinal and transverse directions, and is then heated. Generally, the web is heated through one surface of the web. A web surface temperature of at least 140° C. is usually suitable for use in the present process. When the web is of isotactic polypropylene fibers having a melting temperature range of about 165° to 170° C., the preferred temperatures which the heated surface of the web should reach are in the range of 140° to 157° C. Web surface temperatures in the range of 145° to 156° C. are particularly preferred. When only a small portion (e.g., 10-20%) of the fibers in the web meet the melting range criterion, as for example in the polyester homopolymer and copolymer webs of Examples 7-11, heating the web surface to a temperature which assures melting of the copolymer fibers, but no melting of the homopolymer fibers, provides a very useful way of operating the process. Thus, when the major portion of the web comprises poly(ethylene terephthalate) filaments having melting temperatures in the range of about 235° to 245° C. and a small portion of copolyester filaments having melting temperatures in the range of about 160° to 180° C., the web may be heated to a surface temperature as high as 215° C. or more without detrimentally affecting the process. For such polyester webs, it is preferred to heat the web surfact to a temperature in the range of 195° to 210° C. Infra-red heaters are convenient for performing the heating steps, though other forms of heating are also suitable. During the heating, fibers of the web are fixed or fused in place to provide further strengthening of the web. Note that during heating of most webs, it is necessary to maintain the webs under tension to avoid excessive and nonuniform shrinkage.

Usually the burnishing step is carried out by means of a rotating, highly polished metal roll. The roll rotates with a peripheral velocity that provides a relative velocity between the needled, heated web and the roll surface of at least 25 meters per minute. In the burnishing step, the roll is maintained in intimate frictional contact with the heated web for at least one second. As a result of the burnishing a glazed-like surface is imparted to the web. The burnishing permits obtaining an abrasion-resistant, uniform-appering surface on one side of the web while maintaining softness and desirable bulk in the overall nonwoven fabric.

In performing the burnishing step, the surface temperature of the burnishing roll is usually maintained at a temperature of less than 130° C. It is of course possible to heat the web surface further by burnishing with a roll whose temperature is higher than that of the web. However, because of economy and the generally more uniform surface and lesser shrinkage that result, it is preferred to cool the web surface while it is being burnished. Thus, burnishing roll surface temperatures are preferred which are less than 60° C. when operating with polypropylene webs and less than 90° C. when operating with polyester webs. The most preferred burnishing roll surface temperatures are lower than 35° C. The lowest burnishing roll temperatures minimize undesirable web shrinkage that can occur in the process.

By varying the temperatures to which the webs are heated and the temperatures at which the burnishing roll operates, a degree of control can be maintained over the resultant properties and characteristics of the final nonwoven fabric. The process of the present invention has provided useful, novel, strong nonwoven fabrics having an abrasion-resistant burnished surface. The fabric comprises substantially continuous filaments of synthetic organic polymer, preferably of isotactic polypropylene or of polyester. The filaments are of 1.5 to 15 dtex, preferably 3 to 7 dtex and the fabric weighs 75 to 150 g/m$^2$, preferably 85 to 115 g/m$^2$. In addition, the novel burnished fabrics have in combination a sheet grab tensile strength of at least 220 Newtons, a trapezoidal tear strength of at least 100 Newtons, an elongation at 4.54-kg load of 6 to 13% and a Frazier air permeability of at least 90 cubic meters/square meter/minute.

The various web characteristics referred to in the text and in the Examples below are measured by the following methods. In the test method descriptions TAPPI refers to the Technical Association of Pulp and Paper Industry and ASTM refers to the American Society of Testing Materials. Although many of the measurements were made in "English" units, all values are reported in metric units.

Unit weight of the web is measured in accordance with ASTM D 3776-79 and reported in grams/square meter. Thickness is measured in accordance with ASTM D 1117-80 and reported in millimeters. Density is calculated as the unit weight divided by the thickness and is reported in gram/cm$^3$.

Tensile strengths in the longitudinal direction (also called "MD" or machine direction) and transverse direction (also called "XD" or cross-machine direction) of the sheet are measured in accordance with ASTM D 1117-77. These strengths are referred to as "SGT" or sheet grab tensile strength and are reported in Newtons.

Similarly, SGT at a 45 degree angle to the longitudinal direction is measured in accordance with ASTM D 76.

Elongation at 4.54-kg (10-lb.) load is measured in accordance with ASTM D 1682-75 and is reported as a percentage.

Trapezoidal tear strength is measured in accordance with ASTM D 1117, section 14, and reported in Newtons.

Stoll flex abrasion resistance is measured with a 0.908 kg (2 lb.) ball weight and a 0.227-kg (0.5-lb.) plate weight in accordance ASTM D 3884-80 and Taber abrasion resistance is measured with a 1-gm load and CS-10 wheel in accordance with the general method ASTM D 1175-64T.

Frazier air permeability is measured in accordance with ASTM F 778-82 and is reported in cubic meters per square meter per hour (or m/min).

Melting temperature range can be measured with a differential thermal analyzer operated with a heatup rate of 10° C. per minute.

EXAMPLE 1

In this example, a nonwoven fabric of the invention is prepared from substantially continuous filaments of isotactic polypropylene.

The general method of Henderson, U.S. Pat. No. 3,821,062, Example 1, was used to prepare the starting web of this example. However, the present preparation differed from those described in Henderson Example 1 in certain specific ways. For the present example, isotactic polypropylene having a melt flow rate of 41 (as measured in accordance with ASTM D 1238, Procedure B, Condition L) was extruded at 210° C. from spinnerets each having 1050 orifices of 0.51-mm diameter. The fabric-forming machine had four rows of jets extending across the width of the collecting belt. Starting at the upstream end of the collecting belt, the first and second rows contained 13 and 14 spinneret positions, respectively, spaced about 30-cm apart and directing their filament streams traverse (XD) to the direction of the movement of the collecting screen. The third and fourth rows each contained 13 spinneret positions of the same design as the first two rows, also spaced about 30-cm apart, but directing their fiber streams at an angle which was 75 degrees counterclockwise to the transverse direction. Each spinneret in the first two rows extruded 22.2 kg/hr of filaments and in the third and fourth rows extruded 26.8 kg/hr. The bundle of filaments from each spineret was formed into a ribbon of parallel filaments and each ribbon was drawn by successively being passed over a series of six rolls. Except for the last roll, each roll ran at a higher speed than the preceding one, with the major speed increase occuring between the fourth and fifth rolls. The fourth of these rolls was "fluted" or "grooved", as described in U.S. Pat. No. 3,821,026, and was heated to 115° C. The other rolls were not heated. Filaments from the first two rows were drawn 2.3X; those from the third row, 2.2X; and those from the fourth row, 2.0X. The dtex of the drawn filaments were 6.1 dtex from the first and second rows and 4.4 from the third and fourth rows. A 108 g/m$^2$ web was collected on a belt moving at a speed of 50.7 meters/min. The web was then lightly consolidated in a steam bonder, operating at 407 kilopascals (59 psig) and 145° C., and then slit and wound up. The thusly prepared polypropylene starting web had an MD and XD SGT of 44 and 109 Newtons, respectively, a thickness of about 0.36 mm and a density of about 0.29 g/cm$^3$.

After slitting, a lubricating silicone-based finish (Dow Corning® 200 Fluid, 50 centistrokes, sold by Dow Corning Corporation of Midland, Mich.) was applied to the web to facilitate subsequent needle-punching. The finish amounted to about a 1% add-on, by weight of the web.

Equipment of the type depicted in the drawing attached to the application was used to prepare nonwoven fabric of the invention from the above-described starting web. A 422-cm-wide roll 20 of starting web 1, was placed on an unwind stand and forwarded to a needle loom comprising a needle board 50 equipped with barbed needles 51, a stripper plate 52 and a bed plate 53. Unwinding of the starting web was assisted by rolls 40, 41. The needle loom imposed 76 penetrations/cm$^2$, at a depth of 13 mm, with the web moving at 15.1 m/min. While being needled, the web was held under tension by rolls 42,43 and puller rolls 44,45. In needling, the web width contracted 3.8% and its thickness was increased to almost 2 mm. The needled web was then stretched 4.0% in length in its passage from puller rolls 44,45 to the pin rails 62 of a tenter frame. The pin rails were driven by rolls 60,61. Edge heaters 70 were used to strengthen the edge of the needled web and to reheat the pin rails of the frame. The needled web, held at its edges by the heated pins, was stretched about 8% in the transverse direction and then passed under infra-red heaters 71 operating at a 538° C. temperature. The infra-red heaters were positioned 6.4 cm above the web surface and raised the web surface temperature, as measured by infra-red temperature monitor 72, to 151° C. The heated, needled web was then subjected to burnishing by 25.4-cm diameter highly polished, 304-stainless steel roll 10 which rotated with a peripheral speed of about 150 m/min counter to the direction of sheet movement. The surface temperature of the web meeting the burnishing roll was 148° C. The surface temperature of the roll was maintained at 39° C. by means of internally circulated oil which was at a temperature of 24° C. As the web separated from burnishing roll 10 via roll 11, the web surface temperature was 77° C. Contact time of the web with the burnishing roll was 1.5 seconds. The arc over which the web made contact with burnishing roll 10 was about 120 degrees and with idler roll 11, about 90 degrees. The web was then passed through puller rolls 46,47 and wound up on roll 30. Web thickness before and after contact with the burnishing roll was 0.66 mm and 0.58 mm, respectively. Further cooling of the web prior to windup was accomplished by air being blown by circulating fans onto the web surface.

The above-described treatment provided a strong, porous nonwoven fabric having one smooth, glazed, porous surface. Other properties of the fabric are summarized in Table I. The fabric was considered to be satisfactory for use as mattress-spring pocketting.

TABLE I

| | |
|---|---|
| Unit Weight, g/m$^2$ | 101 |
| Sheet Grab Tensile Strength, N | |
| MD | 223 |
| XD | 329 |
| 45 degrees | 298 |
| Trapezoidal Tear Strength, N | |
| MD | 111 |
| XD | 182 |
| % Elongation at 4.54 kg load | |

TABLE I-continued

| | |
|---|---|
| MD | 6.5 |
| XD | 8.3 |
| Thickness, mm | 0.58 |
| Density, g/cm$^3$ | 0.17 |
| Taber Abrasion Resistance (cycles to failure) | 3230 |
| Frazier Air Permeability, | |
| m$^3$/m$^2$/min | 118 |
| % CV | 10.1 |

EXAMPLES 2–5

These examples illustrate the operation of the process of the invention with the same lubricated starting web of isotactic polypropylene filaments as was prepared in Example 1, but under somewhat different conditions, particularly with regard to the burnishing roll surface temperature and speed.

A 57-cm wide roll of starting web of Example 1 was fed to a needle loom at a rate of 0.365 m/min. The barbed needles of the loom imposed 76 penetrations/cm$^2$ at a depth of 15 mm. The needling caused the web width to contract about 4.4%. The needled web was then stretched lengthwise about 4.3%. The infrared heaters were positioned about 16 cm above the web and heated the surface of the web to about 154° C. The surface temperature of the burnishing roll was controlled by oil circulating inside the roll at the temperatures listed in Table II below. Burnishing roll peripheral speed was 9 meters/minute and counter to the direction of web movement. The web was in contact with the burnishing roll over an 82-degree arc of the roll. In examples 2–5, the surface temperature of the burnishing roll was 55°, 83°, 107° and 129° C., respectively. A comparison test was run with the burnishing roll operating with a 177° C. surface temperature. Characteristics of the nonwoven fabrics thusly produced are summarized in Table II.

The data in Table II show the surprising advantage of operating with burnishing roll surface temperatures of less than 130° C., preferably of less than 110° C. and most preferably of less than 60° C. In contrast to the comparison fabric, the fabrics made by the process of the invention advantageously exhibit the lower shrinkage during fabrication (as indicated by the thickness, density and unit weight data), greater uniformity of the fabric surface (as indicated by the small coefficient of variation of abrasion resistance), and greater stoll flex abrasion resistance, as well as other favorable characteristics.

The fabrics of these examples were also compared with fabrics prepared in the same way except that the needled, tensioned and heated webs were calendered rather than having been burnished. The calendering roll exerted a 186-kg load per cm width on the web and operated with a surface temperature in the range of 79° to 143° C. The comparison showed that not only did the burnished samples have advantages in surface uniformity, but also had surprisingly important advantages in abrasion resistance, permeability and tear and tensile strengths over the calendered webs. In addition, the burnished products felt softer and less board-like than the corresponding calendered products.

TABLE II

| Sample | Ex. 2 | Ex. 3 | Ex. 4 | Ex. 5 | Comparison |
|---|---|---|---|---|---|
| Burnishing roll surface temperature, °C. | 55 | 83 | 107 | 129 | 177 |
| Produced nonwoven fabric unit weight, g/m$^2$ | 108 | 108 | 110 | 111 | 116 |
| Sheet Grab tensile, N | | | | | |
| MD | 287 | 268 | 261 | 249 | 232 |
| XD | 386 | 377 | 369 | 348 | 269 |
| 45 degree | 351 | 374 | 347 | 347 | 360 |
| Trapezoidal tear, N | | | | | |
| MD | 102 | 120 | 125 | 107 | 71 |
| XD | 142 | 120 | 134 | 129 | 116 |
| % Elongation at 4.54 kg | | | | | |
| MD | 9 | 9 | 11 | 10 | 12 |
| XD | 10 | 11 | 10 | 9 | 11 |
| Thickness, mm | 0.59 | 0.49 | 0.54 | 0.38 | 0.31 |
| Density, g/cm$^3$ | 0.18 | 0.22 | 0.20 | 0.29 | 0.37 |
| Frazier Air permeability | | | | | |
| m$^3$/m$^2$/min | 105 | 95 | 93 | 85 | 72 |
| % CV | 4.4 | 7.8 | 5.7 | 6.2 | 9.7 |
| Stoll flex abrasion | | | | | |
| MD, cycles | 3120 | 2990 | 2960 | 2950 | 2500 |
| % CV | 3.9 | 3.7 | 3.9 | 3.9 | 4.7 |
| XD, cycles | 3420 | 2730 | 2440 | 2260 | 920 |
| % CV | 3.7 | 3.8 | 4.3 | 4.9 | 9.9 |

EXAMPLE 6

In this Example, a series of isotactic polypropylene nonwoven fabrics was prepared to show how the temperature to which the web is heated prior to burnishing affects the tensile properties of the resultant fabric. Examples 2–5 were repeated except that the burnishing roll surface temperature was maintained at 55° C., while the surface temperature to which the samples were heated prior to burnishing was varied from 122° to 160° C. Table III summarizes the results and shows that superior grab tensile strengths and satisfactory elongations are obtained when the web is preheated to a surface temperature in the range of about 145° to 156° C.

TABLE III

| Web Surface | SGT (Newtons) | | % Elongation at 4.54 kg load | |
|---|---|---|---|---|
| Temperature, °C. | MD | XD | MD | XD |
| 122 | 258 | 165 | 18 | 20 |
| 131 | 307 | 227 | 17 | 19 |
| 139 | 358 | 256 | 13 | 17 |
| 144 | 387 | 309 | 13 | 14 |
| 150 | 396 | 307 | 11 | 13 |
| 154 | 374 | 294 | 10 | 10 |
| 157 | 338 | 280 | 9 | 9.0 |
| 159 | 245 | 231 | 5.5 | 7.8 |
| 160 | 156 | 140 | 4.5 | 5.5 |

EXAMPLES 7–11

In these examples, nonwoven fabrics of the invention are prepared from polyester continuous filaments. The starting webs for these examples were prepared by the general procedures described in Example I of Estes et al. U.S. Pat. No. 3,989,788. The nonwoven starting web comprised four layers 2.4-dtex continuous filaments of polyester polymer. The filaments were deposited onto a moving receiver with a substantially random directionality to the filaments in the thusly formed web. The filaments were melt-spun from two types of polyesters: (a) from polyethylene terephthalate homopolymer having a relative viscosity of 26 (as determined at 25° C. in a solution containing 4.75% by weight of polymer, using hexafluroisopropanol as solvent) and a melting range of 235° to 245° C. and (b) from copolymer of 24 relative viscosity containing about 80% repeating units of polyethylene terephthalate and 20% repeating units of polyethylene isophthalate and having a melting range of 160° to 180° C. The web contained about 78% homopolymer filaments and 22% copolymer filaments. The collected polyester webs were lightly consolidated at 100° C., heated to 130° C. and then cooled, slit and wound up. The polyester starting web had equal MD and XD grab tensile strengths of 31 Newtons each, weighed about 90 g/m$^2$ and measured about 0.4 mm thick. The polyester webs were then lubricated, needled, stretched, heated, burnished and cooled in the same equipment as was used for Examples 2–5 except that the needled web was stretched transversely 19% and the surface temperature of the web was heated to 204° C. The surface temperature of the burnishing roll was controlled in the range of 58° to 165° C., at the values indicated in Table IV below, which also summarizes the results of the tests.

TABLE IV

| Sample | Ex. 7 | Ex. 8 | Ex. 9 | Ex. 10 | Ex. 11 |
|---|---|---|---|---|---|
| Burnishing roll surface temperature, °C. | 58 | 78 | 100 | 127 | 165 |
| Produced nonwoven fabric unit weight, g/m$^2$ | 88 | 86 | 91 | 91 | 91 |
| Sheet Grab tensile, N | | | | | |
| MD | 303 | 320 | 307 | 303 | 267 |
| XD | 285 | 285 | 280 | 285 | 280 |
| 45 degree | 312 | 285 | 303 | 245 | 312 |
| Trapezoidal tear, N | | | | | |
| MD | 209 | 200 | 213 | 258 | 227 |
| XD | 160 | 174 | 169 | 200 | 182 |
| % Elongation at 4.54 kg | | | | | |
| MD | 7 | 5 | 4 | 5 | 11 |
| XD | 14 | 12 | 12 | 15 | 6 |
| Thickness, mm | 0.83 | 0.74 | 0.74 | 0.79 | 0.74 |
| Density, g/cm$^3$ | 0.11 | 0.12 | 0.12 | 0.12 | 0.12 |
| Frazier air permeability | | | | | |
| m$^3$/m$^2$/min | 95 | 96 | 90 | 92 | 91 |
| % CV | 10.5 | 9.5 | 10.6 | 9.7 | 13.2 |
| Taber abrasion cycles | 1000 | 1110 | 1200 | 1270 | 1380 |
| % CV | 28 | 24 | 20 | 44 | 28 |

We claim:

1. A process for preparing a strong, permeable nonwoven fabric having an abrasion-resistant surface, the process comprising (a) providing a lightly consolidated web of thermoplastic, synthetic organic fibers, the web having a unit weight in the range of 75 to 150 grams/square meter, the fibers having a dtex in the range of 1.5 to 15 and at least a minor portion of the fibers having melting temperatures in the range of 160° to 190° C., (b) needle-punching the web to form 30 to 150 penetrations/square centimeter, (c) heating at least one surface of the needled web to a temperature of at least 140° C., (d) burnishing the heated surface of the web with a rotating, smooth-surfacted metal roll and (e) cooling the burnished web.

2. A process of claim 1 wherein the roll rotates with a peripheral velocity of at least 25 meters/minute relative to the web, is maintained in intimate frictional contact with the web for at least one second and simultaneously burnishes and cools the heated, needled web.

3. A process of claim 1 or 2 wherein the lightly consolidated web comprises substantially continuous filaments of isotactic polypropylene, the surface of the needled web is heated to a temperature in the range of 145° to 156° C. and the roll surface is maintained at a temperature of lower than 60° C.

4. A process of claim 1 or 2 wherein the lightly consolidated web comprises a major portion of substantially continuous filaments of poly(ethylene terephthalate) homopolymer and a minor portion of substantially continuous filaments of poly(ethylene terephthalate/isophthalate) copolymer, the needled web is heated to a temperature in the range of 195° to 210° C. and the roll surface is maintained at a temperature of lower than 90° C.

5. A nonwoven fabric having an abrasion-resistant burnished surface, the fabric comprising substantially continuous filaments of synthetic organic polymer of 1.5 to 15 dtex and having a unit weight of 75 to 150 g/m$^2$, a sheet grab tensile strength of at least 220 Newtons, a trapezoidal tear strength of at least 100 Newtons, an elongation at 4.54 kg load of 6 to 13%, and a Frazier air permeability of at least 90 m/min.

6. A nonwoven fabric of claim 5 wherein the filaments are of isotactic polypropylene polymer.

7. A nonwoven fabric of claim 5 wherein the filaments are of polyester polymer.

* * * * *